US005519409A

United States Patent [19]

Uematsu et al.

[11] Patent Number: 5,519,409

[45] Date of Patent: May 21, 1996

[54] PLANE ARRAY ANTENNA FOR RECEIVING SATELLITE BROADCASTING

[75] Inventors: Masahiro Uematsu; Takashi Ojima; Nobuharu Takahashi, all of Tokyo; Atsushi Kaise, Omiya, all of Japan

[73] Assignee: Nippon Steel Corporation, Tokyo, Japan

[21] Appl. No.: 319,527

[22] Filed: Oct. 7, 1994

[30] Foreign Application Priority Data

Oct. 8, 1993 [JP] Japan ..... 5-277891

[51] Int. Cl.[6] ..... H01Q 13/10

[52] U.S. Cl. ..... 343/771; 343/757; 343/763

[58] Field of Search ..... 343/761, 757, 343/756, 763, 766, 771

[56] References Cited

U.S. PATENT DOCUMENTS

| | | | |
|---|---|---|---|
| 2,564,703 | 8/1951 | Litchford et al. | 343/766 |
| 3,022,506 | 2/1962 | Goebels et al. | 343/771 |
| 3,604,009 | 9/1971 | Behnke | 343/757 |
| 3,795,914 | 3/1974 | Pickles | 343/756 |
| 4,040,058 | 8/1977 | Mori et al. | 343/766 X |
| 4,864,314 | 9/1989 | Bond | 343/771 X |
| 5,210,542 | 5/1993 | Pett et al. | 343/757 X |

OTHER PUBLICATIONS

Single-Layer Slotted Leaky Waveguide Array For Mobile DBS Reception, Hirokawa et al., Technical Report of IEICE, A.P. 93-25, pp. 11-17, May 1993.

*Primary Examiner*—Donald T. Hajec
*Assistant Examiner*—Tho Phan
*Attorney, Agent, or Firm*—Pollock, Vande Sande & Priddy

[57] ABSTRACT

This plane array antenna for receiving satellite broadcasts is an optimal combination of the plane array antenna main body having a tilt angle, a converter connected with the antenna main body through the power supply portion, and the rotation mechanism for rotating the antenna main body within almost a horizontal plane for tracking the azimuthal angle direction. The plane array antenna main body has the power supply portion formed at the center of the rotation and the converter includes a dielectric substrate having a microstrip channel formed on the substrate and a casing accommodating the substrate. The converter is fixed downwardly of the antenna main body and supports the antenna main body. The power supply portion includes the power supply probe with an insulation covering, and has its front end portion inserted into a space formed with the antenna body, a central portion extending through the casing of the converter, and the lowest end portion combined with the microstrip channel. The rotation mechanism includes a cylindrical body projecting downwardly from the bottom surface of the antenna main body at the outside of the converter and a driving mechanism for rotating the cylindrical body.

38 Claims, 5 Drawing Sheets

PLANE ARRAY ANTENNA FOR RECEIVING SATELLITE BROADCASTING

BACKGROUND OF THE INVENTION

1. Field of the Invention

The present invention relates to a plane array antenna for receiving satellite broadcasting programs to be utilized by being mounted on a car of the like.

2. Description of the Related Art

Along with the diffusion of satellite broadcasting in recent years, there have been many studies carried out on car-loaded antennas for receiving a satellite broadcast. For this type of car-loaded antenna, one of the important technical issues is how to reduce the height of the antenna technical because it usually is installed on the top of the car which operates under with height restrictions. Further, since the antenna for receiving a satellite broadcasting is fitted on the top of the car with a limited space, one of the important technical issues is also how to reduce the area for installing the antenna. To reduce the height for installation of the antenna, a structure for horizontally fitting the plane array antenna having a tilt angle on the top of the car is considered to be advantageous. Main beams irradiated from this type of plane array antenna are irradiated in a direction which is deviated by a tilt angle from the normal direction of the plane array antenna.

In a car-mounted antenna, an automatic tracking mechanism for controlling both an azimuth angle and an elevation angle of the antenna is necessary so that the antenna can always track a broadcasting satellite that continually changes with movement of the car. The automatic tracking mechanism not only constitutes a substantial portion of the manufacturing expense of the whole receiving system but also increases the height and area needed for the antenna. Therefore, simplification of the automatic tracking system has been one of the important technical issues. Changes of an azimuth angle occur over 360° with movement of the car, and therefore, it is considered realistic to achieve the tracking in the direction of the azimuth angle by a mechanical rotation mechanism. In contrast to this trend, changes of an elevation angle occur along with longitude or the slope from the horizontal plane, that is, the slope of the load of about ±5°. Therefore, the range of the changes of the elevation angle is relatively limited. As a result, it has been considered advantageous to economize the whole receiving system by employing an elevation angle direction non-tracking system not performing mechanical tracking in the elevation angle, or a uniaxial tracking system for tracing only the azimuth angle direction, by setting in advance the wider directivity in the elevation angle direction of the antenna.

A plane array antenna for receiving a satellite broadcasting which is designed to achieve the above-described uniaxial tracking system is described in the paper (A.P 93-25) titled "A SINGLE-LAYER STRUCTURE LEAKAGE WAVE GUIDE SLOT ARRAY CAR-LOADED ANTENNA FOR RECEIVING SATELLITE BROADCASTING", reported by Hirokawa et al. in the technical research report of the Institute of Electronics, Information and Communication Engineers (Japan), held in May 1993. This paper describes a leakage wave guide slot array antenna of a type, in which electric power is supplied in the rotation center (hereinafter, this type will be called as a central power supply type), having a structure as shown in the perspective view in FIG. 5. A main body of the slot array antenna is formed by 12 radiation wave guides 11A to 11L disposed mutually adjacent and parallel with each other, and T-shaped power supply wave guides 12 for supplying radiation power to each radiation wave guide. Each of the T-shaped power supply wave guides 12 is structured by a first part 12A which extends in its layout direction (or row direction) by forming a combining window with one end of each radiation wave guide and a second part 12B which extends from a power supply probe 13 formed at the rotation center position in the azimuth angle direction of the antenna main body, both the first and second parts 12A and 12B forming a T branch. Each of the radiation wave guides 11A to 11L is structured by a leakage wave guide which is formed with cross slots 14 in the axial direction by a suitable number, for example, 13 to 17, each having the same offset, to achieve a beam width of about ±5° around the tilt angle direction of 52°.

The above paper suggests an advantage in that, in to the structure of the central power supply type shown in FIG. 5, when a power supply portion formed by the power supply probe 13 disposed at the center of rotation and is structured as a rotary joint or the like, only the antenna can be rotated within an almost horizontal plane at the time of uniaxial tracking while keeping the converter connected to this power supply portion at the lower side of the antenna main body in a fixed position.

The above paper by Hirokawa et al. shows a structure which enables only the antenna body to be rotated by employing the central power supply type antenna structure and the power supply portion having the rotary joint structure. However, further investigation is necessary in order to achieve an optimal structure. In the central power supply type antenna, the power supply system and the mechanical system for the rotation are complicated and concentrate at the center portion of the antenna because the center portion is important for both of the systems. An attempt to avoid the complexity of both the electrical and mechanical systems would-result in insufficient electrical and mechanical characteristics. If the power supply portion of the rotary joint structure and the converter are connected with a flexible coaxial cable, for example, it is possible to release the converter from the center portion and thus concentrate the rotation mechanical system in the center portion. However, since the frequency of the signal is as high as 12 GHz, a longer coaxial cable causes an increase in the transmitting loss and deterioration of the S/N ratio. On the other hand, fixing of the converter at the center portion of the antenna main body causes a problem that the converter becomes a hindrance so that a usual rotation mechanism combining the rotational axis of the motor with the center of rotation of the antenna main body can not be employed.

SUMMARY OF THE INVENTION

It is, therefore, an object of the present invention to provide a central power supply type plane array antenna, having a structure of an optimal combination of a central power supply type antenna structure, a current supply portion of a rotary joint structure and a rotation mechanism.

According to the present invention, a plane array antenna for receiving a satellite broadcasting, a main body of the plane array antenna includes a central power supply type structure having a power supply portion located at the center rotation. A converter includes a dielectric substrate having a microstrip channel formed on the substrate and a casing for accommodating this dielectric substrate. The converter is fixed at a lower side of the main body of the plane array antenna and rotatably supports the main body of the plane array antenna. A power supply portion includes a power supply probe having an insulation covering and having its upper end portion inserted into a space in the antenna main body. The probe's center portion passes through the casing of the converter and its lower end portion combines with the microstrip channel formed on the dielectric substrate of the converter. A rotation mechanism for tracking the azimuth angle direction includes a cylindrical body which projects downwardly from the bottom of the antenna main body at the outside of the converter and a driving mechanism is provided for rotating this cylindrical body.

When the main body of the plane array antenna formed by a leakage wave guide slot array antenna or the like is formed which a central power supply type structure as shown in FIG. 5, it is possible also to enable rotation of only the main body of the plane array antenna while keeping the converter in a fixed position. To be more specific, the upper end portion of the power supply probe can be inserted into the rotation center position of the antenna main body and the lower end portion of the power supply probe combines with the microstrip channel formed on the dielectric substrate of the converter so that the antenna main body and the converter can be connected in through shortest possible distance with a transmission channel of a simple coaxial structure. As a result, a power supply mechanism of a simple design with a minimum insertion loss can be achieved. When the antenna main body is rotatably supported by the casing of the converter through which the power supply probe passes, and when the driving mechanism is located outside of the converter which is fixed at the center of the antenna main body, complexity of the power supply system and the mechanical system normally tending to occur at the center portion of the antenna can be effectively avoided and an optimal structure with both excellent electrical and mechanical characteristics can be obtained.

DESCRIPTION OF THE PREFERRED EMBODIMENTS

Figure 1:
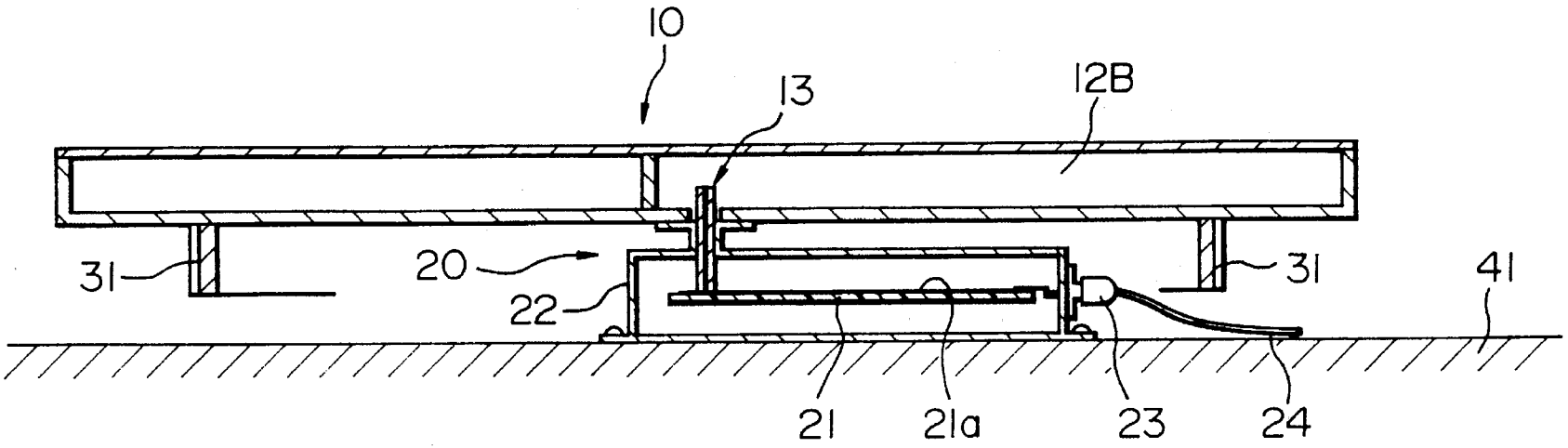
FIG. 1 is a partial cross sectional diagram showing the structure of the periphery of the power supply portion of the plane array antenna according to one embodiment of the present invention.
Figure 2:
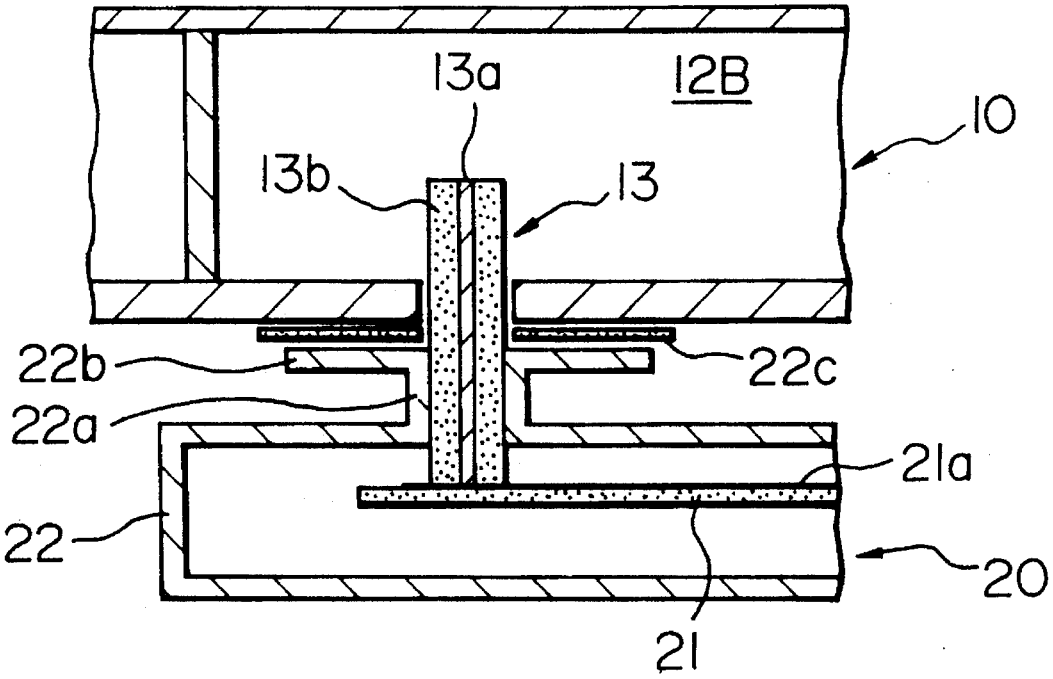
FIG. 2 is a cross sectional diagram of an enlarged portion of the periphery of the power supply portion shown in FIG. 1.
Figure 3:
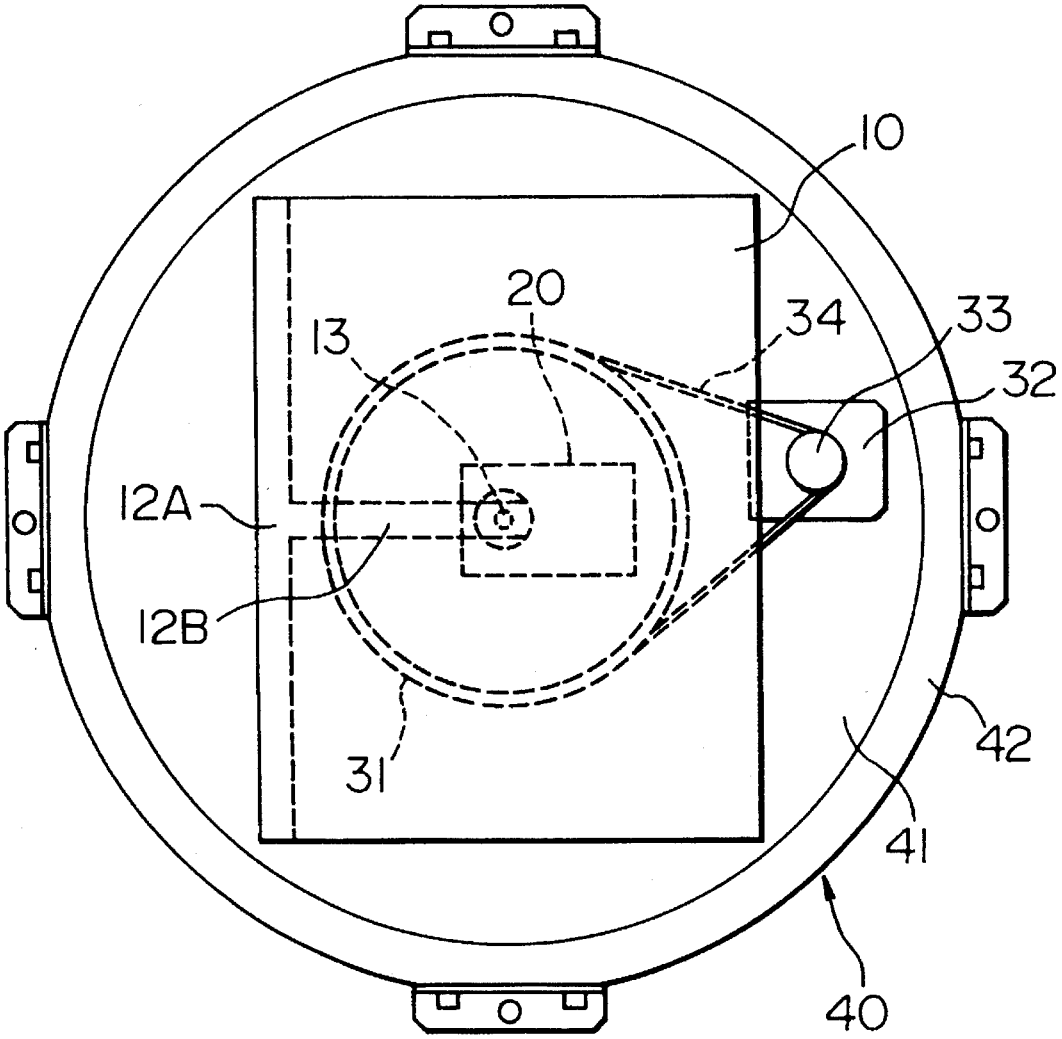
FIG. 3 is a plane diagram showing the whole of the above embodiment.

FIG. 1 is a partial cross-sectional diagram showing the structure periphery of the power supply for a leakage wave guide slot array antenna for receiving satellite broadcasts according to one embodiment of the present invention, FIG. 2 is a partial enlarged diagram of the power supply shown in FIG. 1 and FIG. 3 is a plane diagram of the whole system. Numeral 10 designates a main body of the plane array antenna. In the present embodiment, the main body of the plane array antenna has the same structure as that of the leakage wave guide slot array antenna of the central power supply type shown in FIG. 5. Numeral 20 designates a converter that includes a dielectric substrate 21 on which a microstrip channel is formed and a casing 22 made of metal for accommodating the dielectric substrate 21. The converter 20 is fixed on a bottom surface 41 of a radome 40. Numeral 13 designates a power supply probe defining a power supply portion, and this power supply probe is structured as a cylindrical central pin 13*a* with cylindrical insulation covering 13*b* covering the central pin 13*a*.

Referring to the partial enlarged diagram in FIG. 2, the power supply probe 13 is inserted into a second part 12B of the power supply wave guide while forming a fine space between the upper end portion of the power supply probe and the plane array antenna main body 10. The central portion of the power supply probe 13 extends through the casing 22 of the converter, and the lower end portion of the power supply probe 13 is connected in a stand-straight state by soldering and bonding on a microstrip channel 21*a* formed on the dielectric substrate 21 of the converter 20. The casing 22 of the converter, for allowing the central portion of the power supply probe 13 to extend through it, includes a cylinder portion 22*a* which holds the power supply probe 13 while compressing it in an axial core direction, and a flange portion 22*b* formed at the front end portion of the cylinder portion 22*a* for rotatably supporting the plane array antenna main body 10 through an insulation sheet 22*c*. The radius of the flange portion 22*b* is substantially equal to a ¼ wavelength of the received signal.

Referring to FIGS. 1 and 3, the rotation mechanism is structured by a cylindrical body 31 which projects downwardly from the bottom of the plane array antenna main body 10 on the outside of the converter 20 fixed on the bottom surface 41 of the radome 40, and a driving mechanism for rotating this cylindrical body. The cylindrical body 31 has hills and valleys formed at predetermined distances on the outer periphery of the cylinder body in the circumferential direction, and this is achieved by bond fixing a timing belt on a plane outer periphery. Referring to the plane diagram in FIG. 3, the driving mechanism is structured by a timing belt 34 engaging with the outer periphery of the cylindrical body 31, a pulley 33 for engaging with the timing belt at the outside of the cylindrical body 31 and a motor 32 for rotating the pulley 33. In FIG. 3, 41 designates a bottom surface encircled by a side wall 42 of the radome 40. The casing is fixed on this bottom surface to provide wind-prevention, moisture-prevention and dust-prevention inside the radome 40.

Figure 5:
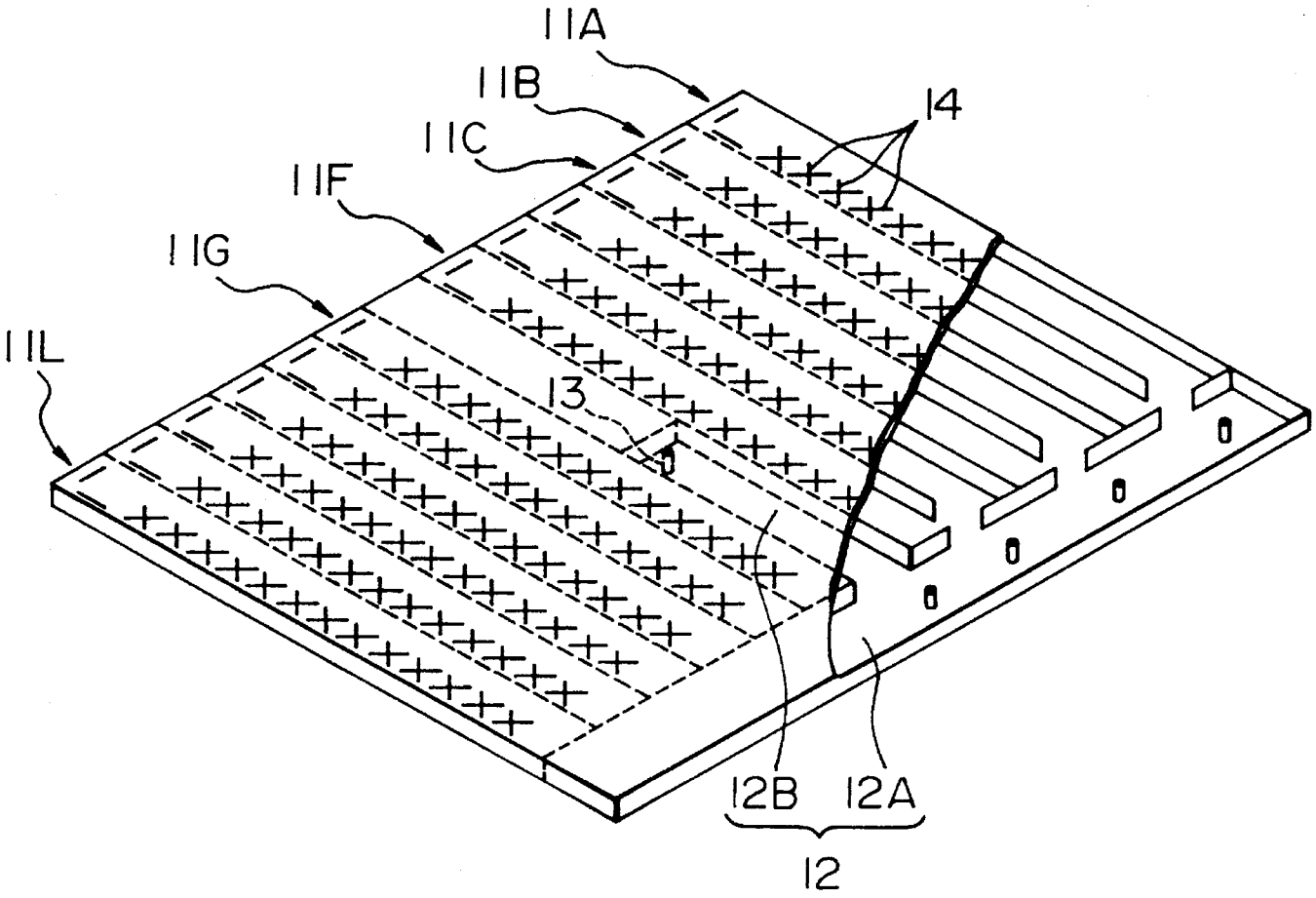
FIG. 5 PRIOR ART
FIG. 5 is a perspective diagram showing the structure of the leakage wave wave guide cross slot array antenna which is one representative example of the central power supply type plane array antenna.

A wave received by the radiation wave guides 11A to 11L shown in FIG. 5 and propagated through the power supply wave guides 12 reaches the power supply probe 13 shown in FIG. 2 and combines with the upper end portion of the power supply probe. The intermediate portion of the power supply probe 13 forms a coaxial channel having the center pin 13*a* as an internal conductor and the cylinder portion 22*a* of the casing 21 as an external conductor. Accordingly, the upper end portion of the power supply probe 13 functions as a wave guide/coaxial mode converter for converting the wave propagated in the wave guide mode into a wave in the coaxial mode. On the other hand, the lower end portion of the power supply probe 13 functions as a coaxial/microstrip mode converter for converting the wave propagated in the coaxial mode at the central portion of the probe 13 into the propagation mode of the microstrip mode and propagating the converted wave to the microstrip channel. The received wave that has been converted into the microstrip mode is then converted into an intermediate frequency signal by a down converter circuit (not shown) installed on the dielectric substrate, and is supplied to a BS tuner through a coaxial connector 23 and a coaxial cable 24 as shown in FIG. 1.

Referring to FIG. 2, the thin (for example, about having 0.2 mm to 0.5 mm thickness) insulation sheet 22*c* is sandwiched between the metal bottom surface of the plane array antenna main body 10 and the metal flange portion 22*b*. This insulation sheet 22*c* prevents abrasion due to friction between the metals. Accordingly, tetra fluoride ethylene of a small coefficient of kinetic friction (TFE; for example, a product name "TEFLON") or the like is suitable as the raw material of the insulation sheet 22*c*. Also, mainly from the viewpoint of the electric characteristics of low loss, tetra fluoride ethylene or the like is suitable as the raw material of the covering 13*b* of the power supply probe 13. At the position where the insulation sheet 22*c* is present, a radial line is formed for radially propagating the wave externally by the surface at which the bottom surface of the antenna main body and the flange portion face each other. Leakage of the wave through the radial line occurs and a propagation loss from the antenna main body to the converter and a subsequent deterioration of frequency characteristics occur. To avoid this problem, the length of the radial line is selected to be almost equal to ¼ of the wavelength of the received wave. As a result, the outside end portion of the radial line is an open end and the above-described leakage problem is reduced to a minimum.

The power supply probe 13 also functions as a central axis in the rotation mechanism formed in combination with the driving mechanism located at the outside of the converter 20. The antenna is usually installed inside the radome and therefore there is no risk of an occurrence of a strong external force being applied in the lateral direction to the power supply probe 13 due to wind pressure. Further, because of the uniaxial tracking system not tracking in the elevation direction, the antenna main body 10 and the casing 20 are maintained almost horizontally, so that there is no risk of a large lateral direction external force being applied to the power supply probe 13. However, various types of lateral direction external force are applied to the power supply probe 13, such as a tensile force to the motor 32 side by the timing belt 34, oscillations and shocks generated along with the running of the car, etc. When such a lateral direction external force as described is transmitted to the junction between the terminal portion of the power supply probe 13 and the microstrip channel 21*a*, there is a risk that the junction may be damaged by a shearing force.

To avoid the above problem, the cylinder portion 22*a* of the casing 22 is strongly compressed in the center direction by a caulking or the like and a larger portion of the lateral direction external force transmitted to the power supply probe 13 is transmitted to the casing 22 through the cylinder portion 22*a*. In order to prevent damage at the fixed portion between the power supply probe 13 and the microstrip channel, a structure may be adopted in which the lower end portion of the center pin 13*a* of the power supply pin probe 13 is connected to the microstrip channel 21*a* through a flexible metal foil placed at the connection point.

Figure 4:
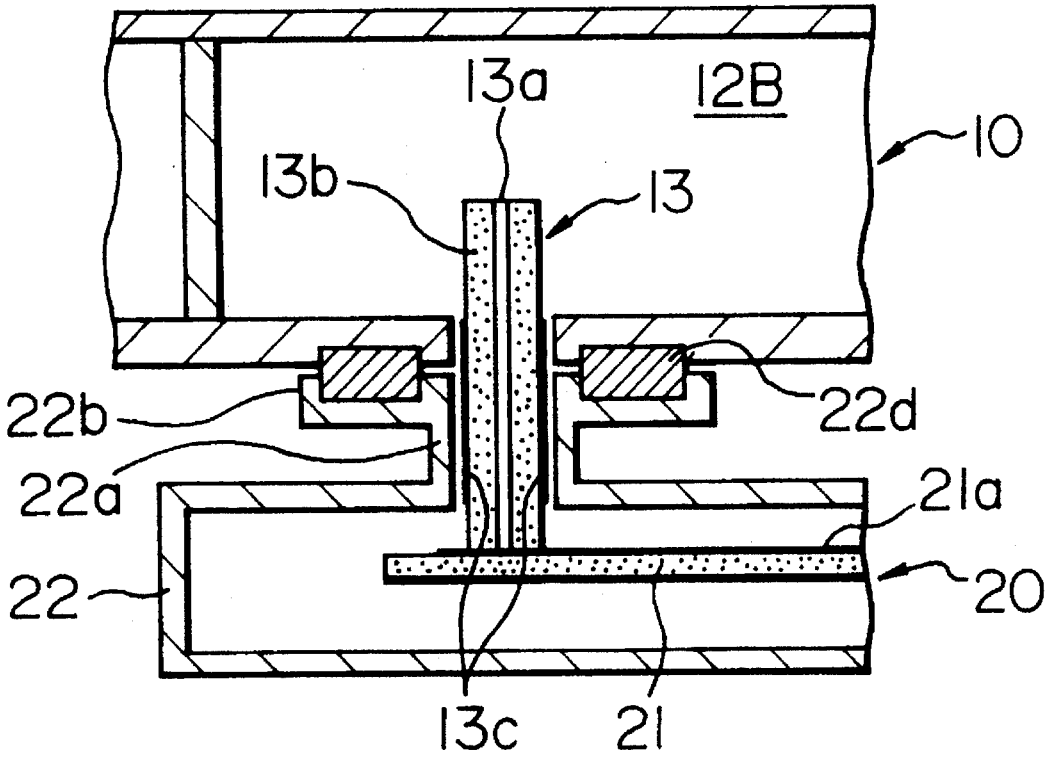
FIG. 4 is a partial cross sectional diagram showing one example of another structure of the periphery of the power supply portion shown in FIG. 1.

A structure as shown in FIG. 4 may be also adopted in which a disk-shaped metal engagement member 22*d* covered with TFE or the like on its surface is placed between the bottom surface of the plane array antenna main body 10 and the flange portion 22*b* to form a small space between the two to rotatably support the antenna main body 10 by the flange portion 22*b*, and at the same time, to form a relatively large space between the cylinder portion 22*a* of the casing 22 and the power supply probe 13. In other words, the lateral direction external force applied to the antenna main body 10 is transmitted directly only to the flange portion 22*b* through the engagement member 22*d*. A vertically directed external force applied to the antenna main body 10 is entirely transmitted only to the flange portion 22 in the same manner as the weight of the antenna main body 10. With the above-described structure, the external force applied to the plane array antenna main body 10 can all be transmitted directly to the casing 22 through the engagement member 22*d* and the flange portion 22*a*, with no external force being transmitted to the power supply probe 13.

In the structure shown in FIG. 4, there is a risk that an inner peripheral distance between the power supply probe 13 and the cylinder portion 22*a* fluctuates due to the manufacturing conditions or a distortion of the cylinder portion 22*a* by the lateral direction load during the use of the system, leading to a fluctuation in the electrical characteristics. To avoid this risk, a metal film 13*c* is formed on the outer periphery of the insulation covering 13*b* at the center portion of the power supply probe 13 so that the power supply probe 13 itself takes a coaxial cable structure. The structure of the coaxial cable can also be applied to the case of FIG. 1.

The above description has been made to explain the present invention in the case where the plane array antenna main body is structured by the leakage wave guide cross slot array antenna. However, it is obvious that the present invention can also be applied to other suitable forms of central power supply type plane array antenna, such as an antenna which is a combination between a radial line and a helical antenna device, an antenna which is a combination between a radial line and a microstrip antenna device, and the like.

In the above embodiments, the structure using a timing belt, a pulley and a motor has been shown as an example of the driving mechanism. However, it is also obvious that the driving mechanism can also be achieved by using a pinion which is a cylindrical body projected downwardly from the antenna main body, and a rack which is proceeded or receded by the motor by being engaged with this pinion.

Further, a above embodiments have the structure in which the cylindrical portion 22*a* for passing the power supply probe 13 through it and for rotatably supporting the antenna main body 10 and the flange portion 22*b* are integrally formed with the casing 22 of the converter 20. However, it is obvious that the cylindrical portion and the flange portion may be formed separately from the casing 22 and afterwards fixed to the casing 22.

The case of using a metal casing for the converter has been shown in the above for providing an electrostatic shielding. However, such a structure may be adopted in which the casing is formed by a resin to avoid corrosion and a metal thin plate is applied to the inner side of the casing for electrostatic shielding. Further, as with the structure of FIG. 3, instead of using the insulation sheet 22*c*, such a structure may be adopted in which a resin such as TFE or the like is coated or plated to the flange portion 22*b* or to the bottom surface of the antenna main body which contacts with the flange portion.

As described in detail above, the plane array antenna for receiving a satellite broadcast according to the present invention has a structure combining the power supply probe with the microstrip channel formed on the dielectric substrate of the converter so that the antenna main body and the converter can be connected with the shortest possible distance by a transmission channel of a most simple structure.

As a result, a power supply mechanism with a minimum insertion loss can be achieved with a simple design.

Further, the plane array antenna for receiving a satellite broadcasting according to the present invention has a structure that the antenna main body is rotatably supported by the casing of the converter through which the power supply probe extends and the driving mechanism is located at the outside of the converter which is fixed to the center portion of the antenna main body, so that complexity of the power supply system and the mechanical system-which tend to be integrated at the center portion of the antenna can be effectively avoided. Thus, an optimal structure with both excellent electrical and mechanical characteristics can be achieved.

We claim:

1. A plane array antenna for receiving a satellite broadcast, comprising;

a plane array antenna main body;

a feeding probe electromagnetically combined with said plane array antenna main body and including an insulation covering;

a converter for converting a frequency of a radio signal received by said plane array antenna main body, said converter including a dielectric substrate with a microstrip line formed thereon and a casing accommodating said dielectric substrate therein; and a rotation mechanism for rotating said plane array antenna main body within a substantially horizontal plane to track a direction from which said satellite broadcast is transmitted, wherein:

said feeding probe extends through said casing of said converter so that an upper part of said feeding probe is inserted into said plane array antenna main body with a gap formed therebetween and a lower part of said feeding probe is electrically connected to said microstrip line formed on said dielectric substrate of said converter; and said converter is fixed at a foundation of said plane array antenna and includes a rotation supporting member, formed on said casing of said converter, for rotatably supporting said plane array antenna main body and using said feeding probe as a central axis.

2. A plane array antenna according to claim 1, wherein:

said cylindrical body of said rotation mechanism has trenches at predetermined intervals along the circumference of the outer periphery of said cylindrical body; and said driving mechanism includes a timing belt engaging with said trenches along the outer periphery of said cylindrical body, a pulley engaged with said timing belt at an outside of said cylindrical body and a motor for rotating said pulley.

3. A plane array antenna according to claim 1, wherein said rotation supporting member has a cylindrical portion for coaxially surrounding said feeding probe and a flange portion, formed at an upper part of said cylindrical portion, for rotatably supporting said plane array antenna main body.

4. A plane array antenna according to claim 2, wherein said rotation supporting member has a cylindrical portion for coaxially surrounding said feeding probe and a flange portion, formed at an upper part of said cylindrical portion, for rotatably supporting said plane array antenna main body.

5. A plane array antenna according to claim 3, wherein said flange portion has a radius which is substantially equal to ¼ of a wavelength of a received radio signal.

6. A plane array antenna according to claim 4, wherein said flange portion has a radius which is substantially equal to ¼ of a wavelength of a received radio signal.

7. A plane array antenna according to claim 3, wherein said plane array antenna main body is rotatably supported by said flange portion through a disk-shaped engaging member which prohibits a relative displacement between said plane array antenna main body and said flange portion in the horizontal direction and a gap between said plane array antenna main body and said flange portion.

8. A plane array antenna according to claim 4, wherein said plane array antenna main body is rotatably supported by said flange portion through a disk-shaped engaging member which prohibits a relative displacement between said plane array antenna main body and said flange portion in the horizontal direction and a gap between said plane array antenna main body and said flange portion.

9. A plane array antenna according to claim 5, wherein said plane array antenna main body is rotatably supported by said flange portion through a disk-shaped engaging member which prohibits a relative displacement between said plane array antenna main body and said flange portion in the horizontal direction and a gap between said plane array antenna main body and said flange portion.

10. A plane array antenna according to claim 6, wherein said plane array antenna main body is rotatably supported by said flange portion through a disk-shaped engaging member which prohibits a relative displacement between said plane array antenna main body and said flange portion in the horizontal direction and a gap between said plane array antenna main body and said flange portion.

11. A plane array antenna according to claim 1, wherein said feeding probe has a metal film formed on outer periphery of said insulation covering at least a central part thereof.

12. A plane array antenna according to claim 1, wherein said plane array antenna main body includes radiation wave guides disposed in parallel and a feeding wave guide for electromagnetically combining said radiation wave guides with said feeding probe.

13. A plane array antenna according to claim 1, wherein said rotation mechanism includes a cylindrical body projecting downwardly from a bottom surface of said plane array antenna main body at an outside of said converter and a driving mechanism for rotating said cylindrical body.

14. A plane array antenna for receiving a satellite broadcast, comprising:

a plane array antenna main body;

a feeding probe electromagnetically combined with said plane array antenna main body and including an insulation covering;

a converter for converting a frequency of a radio signal received by said plane array antenna main body, said converter including a dielectric substrate having a microstrip line formed thereon and a casing for accommodating said dielectric substrate therein; and a rotation mechanism for rotating said plane array antenna main body within a substantially horizontal plane so as to track a direction from which said satellite broadcast is transmitted, wherein:

said feeding probe extends through said casing of said converter so that an upper part of said feeding probe is inserted into said plane array antenna main body with a gap formed therebetween and a lower part of said feeding probe is electrically connected to said microstrip line formed on said dielectric substrate of said converter; and said converter is fixed at a foundation of said plane array antenna and includes a rotation supporting member formed on said casing of said converter, said rotation supporting member having a cylindrical portion for coaxially surrounding said feeding probe and a flange portion, formed at an upper part of said cylindrical portion for rotatably supporting said plane array antenna main body through a disk-shaped engaging member which prohibits a relative displacement between said plane array antenna main body and said flange portion in the horizontal direction and forms another gap between said plane array antenna main body and said flange portion.

15. A plane array antenna according to claim 14, wherein said rotation mechanism includes a cylindrical body projecting downwardly from a bottom surface of said plane array antenna main body at an outside of said converter and a driving mechanism for rotating said cylindrical body.

16. A plane array antenna according to claim 15, wherein:

said cylindrical body of said rotation mechanism has trenches formed on an outer periphery thereof at predetermined distances in a circumferential direction; and said driving mechanism includes a timing belt engaging said trenches on the outer periphery of said cylindrical body, a pulley engaged with said timing belt at an outside of said cylindrical body and a motor for rotating said pulley.

17. A plane array antenna according to claim 14, wherein a radius of said flange portion is substantially equal to ¼ of a wavelength of a received signal.

18. A plane array antenna according to claim 16, wherein a radius of said flange portion is substantially equal to ¼ of a wavelength of a received signal.

19. A plane array antenna for receiving a satellite broadcasting, comprising:

a plane array antenna main body having wave guides;

a rotation mechanism for rotating said plane array antenna main body within a substantially horizontal plane so as to track a direction from which said satellite broadcast is transmitted;

a feeding probe placed at the center of rotation of said plane array antenna main body;

a converter, fixed at a foundation of said plane array antenna and electromagnetically connected with said plane array antenna main body through said feeding probe, for converting a frequency of a radio signal received by said wave guides of said plane array antenna main body; and a rotation supporting member, formed on a casing of said converter, for rotatably supporting said plane array antenna main body, wherein:

said feeding probe extends through said casing of said converter so that an upper part of said feeding probe is inserted into one of said wave guides of said plane array antenna main body.

20. A plane array antenna according to claim 19, wherein a lower part of said feeding probe is electrically connected to a microstrip line formed on a dielectric substrate of said converter.

21. A plane array antenna according to claim 19, wherein:

said upper part of said feeding probe includes first converter means for converting a radio signal of a wave guide mode received by said plane array antenna main body into a coaxial mode signal; and a lower part of said feeding probe includes second converter means for converting said coaxial mode signal into a microstrip mode signal.

22. A plane array antenna according to claim 19, wherein said rotation mechanism includes a cylindrical body projecting downwardly from a bottom surface of said plane array antenna main body at an outside of said converter and a driving mechanism for rotating said cylindrical body.

23. A plane array antenna according to claim 19, wherein said rotation supporting member includes a cylindrical portion for coaxially surrounding said feeding probe and a flange portion, formed at an upper end of said cylindrical portion, for rotatably supporting said plane array antenna.

24. A plane array antenna according to claim 23, wherein a radius of said flange portion is substantially equal to ¼ of a wavelength of a received radio signal.

25. A plane array antenna according to claim 23, wherein said plane array antenna main body is rotatably supported by said flange portion through a disk-shaped engaging member which prohibits a relative displacement between said plane array antenna main body and said flange portion in the horizontal direction and forms a gap between said plane array antenna main body and said flange portion.

26. A plane array antenna according to claim 19, wherein said plane array antenna main body includes radiation wave guides disposed in parallel with each other and a feeding wave guide for electromagnetically connecting said radiation wave guides with said feeding probe.

27. A plane array antenna according to claim 19, wherein said rotation supporting member rotatably supports said plane array antenna main body using said feeding probe as a central axis.

28. A plane array antenna according to claim 19, wherein said plane array antenna tracks the direction from which said satellite broadcast is transmitted only within said substantially horizontal plane and around one axis.

29. A plane array antenna for receiving a satellite broadcast, comprising:

a plane array antenna main body having wave guides;

a rotation mechanism for rotating said plane array antenna main body within a substantially horizontal plane to track a direction from which said satellite broadcast is transmitted;

a feeding probe placed at a rotational center of said plane array antenna main body;

a converter, fixed at a foundation of said plane array antenna and electromagnetically connected with said plane array antenna main body through said feeding probe, for converting a frequency of a radio signal received by said wave guides of said plane array antenna main body; and a rotation supporting member, formed on a casing of said converter, for rotatably supporting said plane array antenna main body, wherein:

said feeding probe extends through said casing of said converter so that an upper part of said feeding probe is inserted into one of said wave guides of said plane array antenna main body and a lower part of said feeding probe is electrically connected to said converter.

30. A plane array antenna according to claim 29, wherein said rotation supporting member includes a cylindrical portion for coaxially surrounding said feeding probe and a flange portion, formed at an upper end of said cylindrical portion, for rotatably supporting said plane array antenna.

31. A plane array antenna according to claim 29, wherein a lower part of said feeding probe is electrically connected to a microstrip line formed on a dielectric substrate of said converter.

32. A plane array antenna according to claim 29, wherein:

said upper part of said feeding probe includes first converter means for converting a radio signal of a wave guide mode received by said plane array antenna main body into a coaxial mode signal; and a lower part of said feeding probe includes second converter means for converting said coaxial mode signal into a microstrip mode signal.

33. A plane array antenna according to claim 29, wherein said rotation mechanism includes a cylindrical body projecting downwardly from a bottom surface of said plane array antenna main body at an outside of said converter and a driving mechanism for rotating said cylindrical body.

34. A plane array antenna according to claim 29, wherein said rotation supporting member rotatably supports said plane array antenna main body using said feeding probe as a central axis.

35. A plane array antenna according to claim 30, wherein a radius of said flange portion is substantially equal to ¼ of a wavelength of a received signal.

36. A plane array antenna according to claim 30, wherein said plane array antenna main body is rotatably supported by said flange portion through a disk-shaped engaging member which prohibits a relative displacement between said plane array antenna main body and said flange portion in the horizontal direction and forms a gap between said plane array antenna main body and said flange portion.

37. A plane array antenna according to claim 29, wherein said plane array antenna main body includes radiation wave guides disposed in parallel with each other and a feeding wave guide for electromagnetically combining said radiation wave guides with said feeding probe.

38. A plane array antenna according to claim 29, wherein said plane array antenna tracks the direction, from which said satellite broadcasting is transmitted only within said substantially horizontal plane and around one axis.

* * * * *